US005643863A

United States Patent [19]

Guerin et al.

[11] Patent Number: 5,643,863

[45] Date of Patent: Jul. 1, 1997

[54] DETERGENT COMPOSITIONS COMPRISING POLYIMIDE/SILICATE COBUILDER PREFORMULATIONS

[75] Inventors: Gilles Guerin, Eaubonne; Arnaud Ponce, Aubervilliers, both of France

[73] Assignee: Rhone-Poulenc Chimie, Courbevoie Cedex, France

[21] Appl. No.: 603,178

[22] Filed: Feb. 20, 1996

Related U.S. Application Data

[63] Continuation of Ser. No. 271,957, Jul. 8, 1994, abandoned.

[30] Foreign Application Priority Data

Jul. 8, 1993 [FR] France ..... 93 08385

[51] Int. Cl.[6] ..... C11D 3/08; C11D 3/37; C11D 17/06

[52] U.S. Cl. ..... 510/466; 510/475; 510/477; 510/361; 510/531

[58] Field of Search ..... 252/135, 173, 252/174.14, 174.23, DIG. 14, DIG. 15, DIG. 6; 510/466, 475, 477, 531, 361

[56] References Cited

U.S. PATENT DOCUMENTS

| | | | |
|---|---|---|---|
| 4,732,693 | 3/1988 | Hight . | |
| 4,911,856 | 3/1990 | Lokkesmoe et al. | 252/95 |
| 5,266,237 | 11/1993 | Freeman et al. | 252/542 |
| 5,393,868 | 2/1995 | Freeman et al. | 528/480 |

FOREIGN PATENT DOCUMENTS

| | | |
|---|---|---|
| 0511037 | 10/1992 | European Pat. Off. . |
| 0561452 | 9/1993 | European Pat. Off. . |

*Primary Examiner*—Margaret Einsmann

*Attorney, Agent, or Firm*—Burns, Doane, Swecker & Mathis, L.L.P.

[57] ABSTRACT

Detergency builder/cobuilder preformulations, for improvedly stable/biodegradable detergent compositions, comprise intimate admixture of at least one polyimide polymer and at least one silicate, advantageously in the form of cogranulates thereof, said at least one polyimide polymer generating at least one biodegradable water-soluble polypeptide species when contacted with an aqueous medium having a non-alkaline pH.

18 Claims, No Drawings

DETERGENT COMPOSITIONS COMPRISING POLYIMIDE/SILICATE COBUILDER PREFORMULATIONS

This application is a continuation of application Ser. No. 08/271,957, filed Jul. 8, 1994, now abandoned.

BACKGROUND OF THE INVENTION

1. Field of the Invention:

The present invention relates to novel biodegradable "builder" or "cobuilder" preformulations for detergent compositions based on a polyimide and silicate admixture.

By the terms "builder" or "cobuilder" are intended any constituent which improves or enhances the performance of the surfactants in a detergent composition.

2. Description of the Prior Art:

In general, it is known to this art that a detergent "builder" or "cobuilder" serves many functions in a washing or wash liquor. Notably, it can:

(1) effect the removal of undesirable ions, in particular alkaline earth metal (calcium, magnesium) ions by sequestration or precipitation, to prevent the precipitation of anionic surfactants, (2) provide a reserve of alkalinity and of ionic strength, (3) maintain extracted soiling materials in suspension, (4) prevent mineral encrustations onto the laundry during washing.

The tripolyphosphates have long been the builders most typically incorporated into detergent compositions and washing products. However, these are partially responsible for the eutrophication of lakes and slow flowing water when they are not adequately removed by water purification facilities; efforts are thus being made to replace them partially or completely.

Zeolites alone cannot replace the tripolyphosphates; their action has to be reinforced by other additives.

Copolymers of acrylic acid and maleic anhydride (or their alkali metal or ammonium salts) have been described (EP-25,551) as detersive encrustation inhibitors. They present, however, the drawback of not being biodegradable in a natural environment.

To respond to biodegradability requirements, it has been proposed to employ, as a "builder" or "cobuilder" agent for detergent compositions, a range of compounds, peptide polymers, and more precisely amino acid polymers or copolymers.

In particular, sodium polyaspartates and polyglutamates, advantageous by reason of their high biodegradability, display good builder or cobuilder activity (U.S. Pat. No. 4,428,749). It has been demonstrated that it is the negatively charged form of these compounds which is the active species in the detergent formulation.

However, the incorporation of these compounds in their native form in detergent compositions does not prove to be satisfactory. After prolonged storage, the compounds suffer chemical attack on contact with the other constituents of the washing formulation, such as oxidizing and basic agents, ultimately resulting in their degradation.

More recently, it has been proposed to use a precursor of this type of "builder" agent, namely, their polycondensation product (EP-511,037). In contrast to the acid derivatives, polyimides have the advantage of being stable in detergent formulations for prolonged periods of time.

Unfortunately, these compounds are not completely satisfactory at an ecological level, since they are not themselves biodegradable as such. In a detergent medium, namely, in an aqueous alkaline medium, they are converted into a biodegradable species, but, in neutral medium, they remain in a water-insoluble and thus non-biodegradable form.

SUMMARY OF THE INVENTION

Accordingly, a major object of the present invention is to optimize the biodegradable nature, or biodegradability, of the aforesaid polycondensation compounds.

Another object of this invention is the provision of particular detersive formulations of such polycondensation products that simultaneously satisfy the following two requirements: (a) they remain stable in the washing formulation and, (b) in liquid medium, when contacted with an aqueous medium of non-alkaline pH, are converted into at least one biodegradable water-soluble species which, of course, remains active in the detergent formulation. Thus, optimization of biodegradability is not achieved at the expense of stability in the detergent formulation, or of subsequent generation of the active species.

By "non-alkaline pH" is intended a pH which does not promote hydrolysis of the polyimide into its water-soluble salts. The pH values of natural aqueous media, of river water type, which have values close to neutrality, are in particular envisaged thereby.

Briefly, the present invention features a "builder" or "cobuilder" preformulation for detergent compositions, comprising at least one polyimide intimately admixed with at least one silicate and which generates at least one biodegradable water-soluble polypeptide species when contacted with, or introduced into, an aqueous medium of non-alkaline pH.

DETAILED DESCRIPTION OF BEST MODE AND PREFERRED EMBODIMENTS OF THE INVENTION

More particularly according to the present invention, it has now unexpectedly been found that the combination of a silicate with a polyimide, and more especially intimate admixtures thereof, provides detersive preformulations which are improved in respect of biodegradability. This mixture of the two components is advantageously provided in a pulverulent form, in particular in the form of cogranulates.

The activity of the subject admixtures can be explained as follows, without, however, wishing to be bound by or to any particular theory: when this specific preformulation of polyimide polymer is contacted with a significant amount of moisture, or even encounters a non-alkaline aqueous medium, the pH is decreased in the immediate vicinity of the grains or particles which induces the formation, at the surface of the mixture and more particularly at the external surfaces of the cogranulates, of a silica layer. This silica layer, in being formed, will advantageously preserve the core of the cogranulates containing polyimide and unreacted silicate. In this manner, by virtue of this silica "shell," sufficient alkalinity, generated by the silicates, is conserved in the polyimides to permit the partial or total hydrolysis of said polyimide into its water-soluble poly(amino acid) salt (s) which do not contaminate the environment.

This advantageous result is all the more surprising, since it would not have been considered possible. Indeed, it would have been expected that the polyimide polymer would immediately be converted into its water-soluble salts when it is intimately mixed with the silicate, and more particularly when the silicate is in the form of a concentrated aqueous dispersion. In this hypothesis, the ultimate result would be a detergent formulation which directly includes the water-soluble polyimide salts, with the inherent problems of instability indicated above. To the contrary, however, according to the present invention, on completion of the intimate mixing of the two components, a paste is obtained which, when dry, provides a powder in which the polyimide is present in its starting form.

Thus, the present invention therefore features a "builder" or "cobuilder" preformulation for detergent compositions incorporating at least one silicate, in varied proportions, in intimate admixture with at least one polyimide. In the subject preformulations, the polyimide/silicate ratio by weight ranges from 99/1 to 1/99.

In a preferred embodiment of the present invention, the silicate is introduced, in admixture with the polyimide, in an amount which is at least sufficient to effect, in non-alkaline aqueous medium, the complete hydrolysis of said polyimide into its water-soluble salt(s) of its corresponding poly(amino acid) salt(s).

The polyimide/silicate ratio by weight preferably ranges from 10/90 to 55/45 and more preferably from 40/60 to 55/45.

By "polyimide polymer" is intended a polyimide biopolymer whose $COO^-$ charge density increases in the washing bath.

Exemplary such polyimide biopolymers include the polyimides prepared by polycondensation of amino diacids, in particular aspartic or glutamic acid, or of the precursors of these amino diacids; these polymers dissolve in water at a basic pH with the formation of free $COO^-$ functions.

These polymers can be either homopolymers prepared from aspartic or glutamic acid, or copolymers prepared from aspartic acid and glutamic acid in any proportions, or copolymers prepared from aspartic and/or glutamic acid and other amino acids (for example up to 15% by weight, and preferably less than 5% by weight, of other amino acids).

Exemplary such amino acid comonomers include glycine, alanine, valine, leucine, isoleucine, phenylalanine, methionine, tryptophan, histidine, proline, lysine, arginine, serine, threonine, cysteine, etc.

Said polyimide biopolymers preferably have a weight-average molecular weight on the order of 2,000 to $10^7$, and generally on the order of 3,500 to 60,000.

These biopolymers, in particular the polyimides derived from aspartic or glutamic acid, may be prepared by thermal condensation of said amino diacid or diacids in a substantially anhydrous medium, as described in *J.A.C.S.*, 80, 3361 (1958), *J. Med. Chem.*, 16, 893 (1973), *Polymer*, 23, 1237, (1982), or in U.S. Pat. No. 3,052,655.

The subject polyimides preferably possess a zero $COO^-$ charge density; they can, however, be partially hydrolyzed (by opening a few imide rings with the formation of alkali metal or ammonium carboxylates).

As regards the alkali metal silicates, those to date employed as adjuvants in detergent formulations can generally be used.

However, the most advantageous silicates are those having an $SiO_2/M_2O$ molar ratio of from 1.6 to 3.5. These are available commercially either in the form of concentrated solutions containing approximately 30%–60% by weight of solids, or in the form of atomized and optionally compacted silicate powders.

The silicate preferably has an $SiO_2/M_2O$ molar ratio on the order of 1.6 to 3.5 and more preferably on the order of 1.8 to 2.6.

The silicate can be mixed with the polyimide polymer in any form, whether structured (powder, granules and the like) or unstructured.

In a preferred embodiment of the invention, an aqueous solution is used containing approximately 30%–60%, preferably approximately 35%–60%, by weight of solids of an alkali metal silicate, especially with an $SiO_2/M_2O$ ratio on the order of 1.6 to 3.5, preferably on the order of 1.8 to 2.6, with M preferably being a sodium atom.

In another embodiment of the invention, the subject preformulations can contain an alkali metal carbonate in addition to the polyimide and the silicate. The presence of a carbonate in the preformulation is particularly advantageous as regards stability to moisture.

The carbonate content of the preformulation varies according to the silicate content. The carbonate percentages indicated below are expressed with respect to the total weight of carbonates and silicates.

The carbonate content preferably ranges from 20% to 75%, expressed with respect to the total weight of silicates and carbonates.

Preferred preformulations in accordance with the present invention comprise:

(i) a polyimide polymer content on the order of 5% to 35% by weight of the preformulation, (ii) a silicate content on the order of 40% to 60% by weight of the preformulation, (iii) a water content on the order of 10% to 30% by weight of the preformulation, and (iv) if appropriate, a carbonate content on the order of 20% to 30% by weight, as indicated above.

Particularly preferred preformulations comprise:

(i) a polyimide polymer content on the order of 35% by weight, (ii) a silicate content on the order of 45% by weight, (iii) a water content on the order of 20% by weight, and (iv) if appropriate, a carbonate content on the order of 20% to 30% by weight as indicated above.

The subject polyimide/silicate mixtures, if appropriate with carbonate, can be prepared (by adsorption and/or absorption) by contacting and intimately admixing a concentrated aqueous solution of an alkali metal silicate with an $SiO_2/M_2O$ molar ratio on the order of 1.6 to 3.5, preferably on the order of 1.8 to 2.6, and having a solids content on the order of 30% to 60%, preferably on the order of 35 to 60%, with the polyimide polymer.

The contacting/mixing may be carried out by simple addition, or alternatively by spraying, of the concentrated silicate solution onto the polyimide in any known high-shear mixer, especially of Lodige® type, or in granulating apparatus (drum, dish and the like), at a temperature on the order of 20° C.

The particles of the mixture obtained can be ground, if desired, to provide a mean diameter on the order of 200 to 800 micrometers.

The densified cogranulates are then dried by any known means. A particularly effective technique is drying in a fluidized bed using a stream of air at a temperature on the order of 40° to 150° C., preferably of 40° to 100° C. This operation is carried out for a period of time which is a function of the air temperature, of the water content of the cogranulates on exiting the granulating device and of that desired in the dried cogranulates, and of the fluidization conditions. Adjustment of these various conditions to the desired product is within the skill in this art.

The present invention also features incorporation of the subject preformulations into detergent compositions in any proportions. Such proportions vary widely depending on the specificity of the particular detergent formulation.

By "detergent composition" is intended any powder or liquid washing formulation suitable for use in a machine for washing clothes, a dishwasher and for domestic cleaning purposes in general.

In the specific case of compositions for a washing machine, the amounts used can be on the order of 1% to 60%, and preferably on the order of 3% to 40%, of the weight of such compositions (these amounts are expressed as weight of preformulation with respect to the weight of the detergent composition). However, the above values are provided solely for purposes of illustration and are in no way limiting.

Other than the preformulation according to the present invention, at least one surface-active agent is present in the washing composition in an amount which may range from 8% to 20%, preferably on the order of 10% to 15%, of the total weight of such composition.

Exemplary of these surface-active agents, or surfactants, are:

(a) anionic surface-active agents, for example alkali metal soaps (alkali metal salts of $C_8$–$C_{24}$ fatty acids), alkali metal sulfonates ($C_8$–$C_{13}$ alkylbenzene sulfonates, $C_{12}$–$C_{16}$ alkyl sulfonates), oxyethylenated and sulfated $C_6$–$C_{16}$ fatty alcohols, oxyethylenated and sulfated $C_8$–$C_{13}$ alkylphenols and alkali metal sulfosuccinates ($C_{12}$–$C_{16}$ alkyl sulfosuccinates), and the like;

(b) nonionic surface-active agents, for example polyoxyethylenated $C_6$–$C_{12}$ alkylphenols, oxyethylenated $C_8$–$C_{22}$ aliphatic alcohols, ethylene oxide/propylene oxide block copolymers and, optionally, polyoxyethylenated carboxylic acid amides;

(c) amphoteric surface-active agents, for example alkyldimethylbetaines;

(d) cationic surface-active agents, for example alkyltrimethylammonium or alkyldimethylethylammonium chlorides or bromides.

Various constituents, additives and adjuvants may also be incorporated in the subject washing compositions, such as:

(i) additional "builder" agents, for example:

(1) phosphates, in a proportion of less than 25% of the total weight of the detergent composition, (2) zeolites, in an amount of up to approximately 40% of the total weight of the detergent composition, (3) sodium carbonate, in an amount of up to approximately 80% of the total weight of the detergent composition, (4) nitriloacetic acid, in an amount of up to approximately 10% of the total weight of the detergent composition, (5) citric acid or tartaric acid, in an amount of up to approximately 20% of the total weight of the detergent composition (the total amount of such additional "builders" corresponding to approximately 0.2% to 80%, preferably from 20% to 45%, of the total weight of the detergent composition);

(ii) bleaching agents, for example perborates, percarbonates, chloroisocyanurate and N,N,N',N'-tetraacetylethylenediamine (TAED), in an amount of up to approximately 30% of the total weight of the detergent composition;

(iii) anti-redeposition agents of the carboxymethyl cellulose or methyl cellulose type, in amounts which may range up to approximately 5% of the total weight of the detergent composition;

(iv) anti-encrustation agents, for example acrylic acid/maleic anhydride copolymers, in amounts which may range up to approximately 10% of the total weight of the detergent composition;

(v) fillers of the sodium sulfate type for detergent powders, in an amount which may range up to 50% of the total weight of the detergent composition.

In order to further illustrate the present invention and the advantages thereof, the following specific examples are given, it being understood that same are intended only as illustrative and in nowise limitative.

EXAMPLE 1

Synthesis of a polysuccinimide (PSI) derived from aspartic acid:

The apparatus was a Parmilleux® dryer, including two reaction vessels connected by a pipe. The first was in an air circulation oven and it was provided with an argon inlet. The second was connected to a vacuum pump.

75 kg of L-aspartic acid were introduced into the first vessel. A slight negative pressure was created under an argon flow in the dryer and the reaction mixture was heated at 190°/230° C. for 25 h, 30 min.

After cooling, 54 kg of polysuccinimide were recovered having a molecular weight (determined by GPC) $\overline{Mw}$=5,290, with a polydispersity Index Ip=1.63. 0.34% of water (Karl Fischer) remained in the product.

EXAMPLE 2

Preparation of a "builder" preformulation A according to the invention:

A first "builder" preformulation A, according to the invention, was prepared from 150 g of the PSI of Example 1 and 320 g of an aqueous silicate solution of ratio 2 containing 58% solids, i.e., an excess of silicate. On mixing in a Henry® grinder, at room temperature, the powder+liquid mixture very quickly became a paste which passed through a liquid stage and then was converted into a sticky powder. This powder was then transferred into a high pressure extruder. The cogranulates obtained were dried on the fluidized bed. The composition of the cogranulates, determined by calcination at 950° C. for 3 h, was 44% silicate, 35% PSI and 21% water.

EXAMPLE 3

Preparation of a "builder" preformulation B according to the invention:

A second "builder" preformulation B was prepared, according to the procedure described in Example 2, from 50 g of the PSI of Example 1 and from 114.8 g of an aqueous silicate solution of ratio 2 containing 54% solids, i.e., an excess of silicate. The powder, obtained on conclusion of the reaction, was dried overnight while exposed to the open air and then ground in a Henry® grinder. After sieving, the fraction of granulometry between 800 and 200 μm was recovered. The composition of the cogranulates, determined by calcination, was 34% PSI, 43% dry silicate and 23% water. Chemical analysis of the total carbon and of the silica provided the values: 35% PSI, 41% dry silicate and 24% water.

EXAMPLE 4

Preparation of a "builder" preformulation C according to the invention:

A third "builder" preformulation C was prepared from 105 g of sodium carbonate, 233.5 g of an aqueous sodium silicate solution containing 45% solids and 290 g of the PSI of Example 1. The carbonate and the PSI were stirred for 5 minutes in a Lodige® mixer. The silicate was added in small portions and mixing was continued until a damp and homogeneous powder was obtained. The product was dried on the fluid bed, first while cold and then at 60°/70° C. The carbonate/carbonates+silicates ratio was 1/2.

The washing performances of the preformulations prepared according to the preceding examples were assessed after incorporation of each of these formulations in the laundry washing powder composition which is reported in Table I.

By way of comparison, the examples given below also provide an account of the performances of three control washing powders, one without any builder agent, the second incorporating Sokalan CP5 and the third sodium polyaspartate NaPAsp (prepared by basic hydrolysis of the polysuccinimide described in Example 1):

TABLE I

| COMPOSITION OF THE WASHING POWDER | BUILDER AGENT TESTED | | | | |
|---|---|---|---|---|---|
| | Blank | Sokalan CP5 | NaPAsp | Builder A | Builder B |
| Alkylbenzene sulfonate | 7.50% | 7.50% | 7.50% | 7.50% | 7.50% |
| Rhodasurf LA 90 | 4% | 4% | 4% | 4% | 4% |
| Zeolite 4 A | 24% | 24% | 24% | 24% | 24% |
| Na silicate | 1.50% | 1.50% | 1.50% | 1.50% | 1.50% |
| Na carbonate | 10% | 10% | 10% | 10% | 10% |
| TAED | 2% | 2% | 2% | 2% | 2% |
| Na perborate | 15% | 15% | 15% | 15% | 15% |
| EDTA | 0.10% | 0.10% | 0.10% | 0.10% | 0.10% |
| Builder agent tested | 0 | 3% Sokalan CP5 | 3% NaPAsp | 6% builder A* | 8.5% builder B** |
| Tinopal DMSX | 0.10% | 0.10% | 0.10% | 0.10% | 0.10% |
| Tinopal SOP | 0.10% | 0.10% | 0.10% | 0.10% | 0.10% |
| silicone antifoam | 0.20% | 0.20% | 0.20% | 0.20% | 0.20% |
| alcalaze | 0.15% | 0.15% | 0.15% | 0.15% | 0.15% |
| savinaze | 0.15% | 0.15% | 0.15% | 0.15% | 0.15% |
| Na sulfate | q.s.-for 100% | q.s.-for 100% | q.s.-for 100% | q.s.-for 100% | q.s.-for 100% |

*i.e., 1.75% of active material (polysuccinimide),
**i.e., 3% of active material (polysuccinimide),
Rhodasurf LA 90 is polyoxyethylenated lauric acid marketed by Rhône-Poulenc,
Sokalan CP5 is a maleic acid/acrylic acid copolymer marketed by BASF.

EXAMPLE 5

Determination of the anti-encrustation properties of the "builders" A and B:

Encrustation is evaluated by washing the following reference textiles in a washing machine: testfabric 405 cotton and krefel cotton/polyamide 12A. After 20 washing cycles at 75° C., followed by dryings, the various samples were incinerated at 950° C. for 3 hours and the mineral encrustation was calculated from the ash content expressed with respect to that obtained without the additive.

To assess the stability over time of the anti-encrustation activity of the builders tested, the tests were carried out twice, once as soon as the washing powder was formulated and then after storing same for 1 month at 40° C.

TABLE II

| RESULTS BEFORE STORAGE: | 405 cotton | cotton/polyamide 12A |
|---|---|---|
| Blank | 100% | 100% |
| Builder A | 53% | 65% |

TABLE III

| AFTER STORAGE (40° C.): | 405 cotton | cotton/polyamide 12A |
|---|---|---|
| Na polyaspartate (1 month) | 100% | 100% |
| Builder B (1 month) | 46% | 42% |
| Builder B (2 months) | 59% | 69% |

After storage for 1 month at 40° C., the sodium polyaspartate lost all activity, whereas the builder B still remained effective after 2 months.

EXAMPLE 6

Stability to moisture:

To simulate various treatments to which raw materials for detergency are subjected, the products were stored at 56% and 90% relative humidity at 20° C. Visual observation was carried out. It entailed assessing the degree of caking of the washing powder after storage. For the tests carried out at a degree of humidity of 56%, the degree of caking was assessed according to the flowability of the powder. For those carried out at a degree of humidity of 90%, it was the moisture level of this powder which was employed as a reference.

The results obtained are reported in the following Table IV:

TABLE IV

| CAKING: | DEGREE OF RELATIVE HUMIDITY % | | | | | |
|---|---|---|---|---|---|---|
| No. of | 90% | | | 56% | | |
| days of storage | NaPAsp | Builder A | CP5 | NaPAsp | Builder A | CP5 |
| 1 | dry powder | dry powder | sticky appearance | flows well | flows well | flows well |
| 2 | moist powder | dry powder | sticky powder | flows well | flows well | flows well |
| 3 | moist powder | dry powder | sticky powder | flows well | flows well | does not flow |

It will be seen that the builder A was less sensitive to moisture than CP5 or sodium polyaspartate. It was very good at 56% relative humidity and remained better than the two others at 90% relative humidity.

EXAMPLE 7

Biodegradability:

The "ultimate" biodegradability of the builder B was measured according to AFNOR standard T90-312 (in conformity with international standard ISO 7827).

The test was carried out using:

(i) an inoculum obtained by filtration of inlet water of the Saint-Germain municipal purification plant at Mont d'Or (RhOne);

(ii) a test medium containing $4\times10^7$ bacteria/ml; and (iii) an amount of test product such that the test medium contained a concentration of organic carbon on the order of 40 mg/l.

The degree of biodegradability of the product under test was 45% in 28 days.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A detergency builder/cobuilder preformulation, comprising an intimate structured admixture of at least one polyimide polymer and at least one alkali metal silicate, wherein the polyimide/silicate ratio by weight ranges from about 40/60 to 55/45, said preformulation obtained by forming a mixture by mixing the polyimide polymer with a concentrated aqueous solution of the silicate containing 30–60% by weight of solids of an alkali metal silicate with a $SiO_2/M_2O$ ratio of about 1.6 to 3.5 wherein M is an alkali metal and drying the mixture at a temperature of about 40°–100° C., said at least one polyimide polymer generating at least one biodegradable water-soluble polypeptide species when contacted with an aqueous medium having a non-alkaline pH.

2. The detergency preformulation as defined by claim 1, the amount of silicate therein being such as to effect complete hydrolysis of said polyimide polymer into its water-soluble salt(s) or corresponding poly(amino acid)(s) when contacted with said aqueous medium having a non-alkaline pH.

3. The detergency preformulation as defined by claim 1, said at least one polyimide polymer comprising a biopolymeric polycondensate of an amino diacid or precursor thereof.

4. The detergency preformulation as defined by claim 3, wherein said at least one polyimide polymer comprises a biopolymeric polycondensate of aspartic acid, glutamic acid, mixtures thereof, or precursors thereof.

5. The detergency preformulation as defined by claim 1, said at least one polyimide polymer having a weight-average molecular weight ranging from about 2,000 to $10^7$.

6. The detergency preformulation as defined by claim 5, said at least one polyimide polymer having a weight-average molecular weight ranging from about 3,500 to 60,000.

7. The detergency preformulation as defined by claim 1, said molar ratio ranging from 1.8 to 2.6.

8. The detergency preformulation as defined by claim 1, further comprising a moisture-stabilizing amount of at least one carbonate.

9. The detergency preformulation as defined by claim 8, wherein said at least one carbonate comprises from 20% to 75% by weight with respect to the total weight of silicates and carbonates.

10. The detergency preformulation as defined by claim 1, further comprising up to 30% by weight of water.

11. The detergency preformulation as defined by claim 1, comprising cogranulates thereof.

12. The detergency preformulation as defined by claim 11, said cogranulates having a mean particle diameter ranging from 200 to 800 micrometers.

13. The detergency preformulation as defined by claim 10, comprising from about 5% to 35% by weight of said at least one polyimide polymer, from about 40% to 60% by weight of said at least one silicate, from about 10% to 30% by weight of water, and, optionally a moisture-stabilizing amount of at least one carbonate.

14. The detergency preformulation as defined by claim 13, comprising about 35% by weight of said at least one polyimide polymer, about 45% by weight of said at least one silicate, and about 20% by weight of water.

15. A detergent composition comprising at least one surfactant and the detergency preformulation as defined by claim 1.

16. The detergent composition as defined by claim 15, comprising from about 8% to 20% by weight of said at least one surfactant and about 1% to 60% by weight of said detergency preformulation.

17. The detergent composition as defined by claim 15, further comprising at least one builder other than said detergency preformulation, at least one bleaching agent, at least one anti-redeposition agent, at least one anti-encrustation agent, at least one filler material, or combinations thereof.

18. The detergency preformulation as defined by claim 6, said at least one polyimide polymer having a weight-average molecular weight greater than 30,000.

* * * * *